US006660889B2

(12) United States Patent
Fujimoto et al.

(10) Patent No.: US 6,660,889 B2
(45) Date of Patent: Dec. 9, 2003

(54) METHOD OF MANUFACTURING OXYGENATED FUEL

(75) Inventors: Kaoru Fujimoto, Tokyo-to (JP); Noritatsu Tsubaki, Tokyo-to (JP)

(73) Assignees: Toyota Jidosha Kabushiki Kaisha, Toyota (JP); Genesis Research Institute, Inc., Nagoya (JP)

( * ) Notice: Subject to any disclaimer, the term of this patent is extended or adjusted under 35 U.S.C. 154(b) by 94 days.

(21) Appl. No.: 09/802,969

(22) Filed: Mar. 12, 2001

(65) Prior Publication Data

US 2001/0023553 A1 Sep. 27, 2001

(30) Foreign Application Priority Data

Mar. 27, 2000 (JP) ..... 2000-086770

(51) Int. Cl.[7] ..... C07C 45/00; C07C 27/20; C07C 27/00

(52) U.S. Cl. ..... 568/429; 568/909; 518/700; 518/702; 518/715

(58) Field of Search ..... 518/700, 702, 518/715; 568/909, 429

(56) References Cited

U.S. PATENT DOCUMENTS

| | | | | |
|---|---|---|---|---|
| 2,327,066 A | | 8/1943 | Roelen | |
| 2,609,382 A | | 9/1952 | Mayland | |
| 2,880,241 A | | 3/1959 | Hughes et al. | |
| 3,989,759 A | * | 11/1976 | Yoo | 260/604 |
| 4,518,714 A | * | 5/1985 | Gustafson | 518/721 |
| 6,277,895 B1 | * | 8/2001 | Zhou et al. | 518/715 |

FOREIGN PATENT DOCUMENTS

| | | |
|---|---|---|
| GB | 637389 | 5/1950 |
| GB | 659712 | 10/1951 |
| JP | 11-302669 | 11/1999 |
| WO | 97/01521 | 1/1997 |
| WO | WO97/14768 | 4/1997 |
| WO | WO97/14769 | 4/1997 |

* cited by examiner

*Primary Examiner*—J. Parsa
(74) *Attorney, Agent, or Firm*—Burns, Doane, Swecker & Mathis, LLP

(57) ABSTRACT

A Fischer-Tropsch reaction is conducted using a synthesis gas (mixture of carbon monoxide and hydrogen) as a raw material to synthesize hydrocarbons containing a large amount of olefin. These hydrocarbons are separated into a light fraction and a heavy fraction by means of a heat exchanger and an oxo process is conducted with respect to the olefin contained in the light fraction with a cobalt catalyst. As a result, an oxygenated fuel containing alcohol, aldehyde, etc. is manufactured. The oxygenated fuel made by such a manufacturing method is excellent in lubricity and oxidation stability, has a high cetane number, and is also capable of suppressing generation of soot when the oxygenated fuel is combusted.

7 Claims, 6 Drawing Sheets

TABLE 1

| RUN | CATALYST | CONVERISION(%) 1-hexene | SELECTIVITY (%) isomer | iso-C7-al | 1-C7-al | C7-ol | al and ol | YIELD(%) al + ol |
|---|---|---|---|---|---|---|---|---|
| 1 | 10N | 38.86 | 7.58 | 40.41 | 35.82 | 10.00 | 86.23 | 33.51 |
| 2 | 20N/20N | 98.91 | 7.91 | 43.92 | 43.32 | 2.75 | 89.99 | 89.01 |
| 3 | 5N+5A | 20.80 | 8.13 | 45.95 | 39.79 | 1.92 | 87.66 | 18.23 |
| 4 | 5N+5A+0.5Pt | 42.45 | 12.11 | 44.79 | 33.40 | 1.49 | 79.67 | 33.82 |
| 5 | 5N+5A+0.5Pd | 89.74 | 11.15 | 42.44 | 35.44 | 5.34 | 83.23 | 74.69 |
| 6 | 5N+5A+0.5Ru | 72.41 | 27.46 | 35.64 | 30.77 | 2.27 | 68.68 | 49.73 |

TABLE 2

| SOLVENT | CONVERISION (%) 1-hexene | SELECTIVITY (%) isomer | iso-C7-al | 1-C7-al | C7-ol | al and ol | YIELD (%) al + ol |
|---|---|---|---|---|---|---|---|
| METHANOL | 99.59 | 4.87 | 31.90 | 17.29 | 45.11 | 94.30 | 93.91 |
| ETHANOL | 99.71 | 4.37 | 38.05 | 23.52 | 33.40 | 94.97 | 94.69 |
| 1-PROPANOL | 46.43 | 12.38 | 43.02 | 31.84 | 6.59 | 81.46 | 37.82 |
| n-PENTANE | 30.57 | 13.36 | 37.31 | 44.93 | 0.94 | 83.17 | 25.43 |
| n-HEPTANE | 37.52 | 10.56 | 37.31 | 48.44 | 3.69 | 89.44 | 33.56 |
| n-OCTANE | 3.50 | 18.73 | 28.49 | 52.78 | 0.00 | 81.27 | 2.85 |
| BENZENE | 5.94 | 3.85 | 22.96 | 37.01 | 6.94 | 66.90 | 3.97 |
| TOLUENE | 3.62 | 0.00 | 32.98 | 67.02 | 0.00 | 100.00 | 3.62 |
| THF | 66.93 | 9.69 | 39.44 | 50.87 | 0.00 | 90.31 | 60.45 |
| $H_2O$ | 1.08 | 11.57 | 41.97 | 46.47 | 0.00 | 88.43 | 0.96 |

TABLE 3

| AMOUNT OF IMPREGNATION Co/A.C. | CONVERISION(%) | SELECTIVITY (%) | | | | | YIELD(%) |
|---|---|---|---|---|---|---|---|
| | 1-hexene | isomer | iso-C7-al | 1-C7-al | C7-ol | al and ol | al + ol |
| 2wt% | 0.00 | 0.00 | 0.00 | 0.00 | 0.00 | 0.00 | 0.00 |
| 5wt% | 17.72 | 10.48 | 42.54 | 42.07 | 2.21 | 86.82 | 15.39 |
| 10wt% | 67.78 | 10.26 | 42.74 | 42.18 | 1.38 | 83.30 | 58.49 |
| 20wt% | 92.25 | 14.78 | 41.01 | 37.10 | 2.19 | 80.30 | 74.07 |
| 30wt% | 99.59 | 10.16 | 43.77 | 37.26 | 3.32 | 84.35 | 84.00 |

TABLE 4

| TEMPERATURE (℃) | CONVERISION(%) 1-hexene | SELECTIVITY (%) 1-hexene | isomer | iso-C7-al | 1-C7-al | C7-ol | al and ol | YIELD(%) al+ol |
|---|---|---|---|---|---|---|---|---|
| 100 | 8.70 | 0.00 | 0.83 | 36.03 | 58.76 | 3.17 | 97.96 | 8.52 |
| 110 | 19.77 | 0.00 | 1.87 | 41.37 | 53.13 | 1.18 | 95.68 | 18.92 |
| 120 | 33.77 | 0.00 | 3.98 | 44.75 | 47.78 | 0.37 | 92.91 | 31.37 |
| 130 | 38.59 | 0.00 | 8.18 | 45.97 | 40.53 | 0.44 | 86.95 | 33.56 |
| 140 | 37.49 | 0.00 | 17.26 | 42.54 | 32.68 | 1.59 | 76.81 | 28.79 |
| 150 | 46.16 | 0.76 | 33.80 | 34.82 | 25.01 | 1.06 | 60.89 | 28.10 |
| 160 | 42.38 | 1.97 | 56.09 | 23.03 | 16.10 | 0.18 | 39.32 | 16.66 |
| 180 | 43.96 | 3.42 | 81.46 | 8.76 | 5.78 | 0.00 | 14.55 | 6.40 |

TABLE 5

| PRESSURE (atm) | CONVERISION(%) 1-hexene | SELECTIVITY (%) isomer | iso-C7-al | 1-C7-al | C7-ol | al and ol | YIELD(%) al + ol |
|---|---|---|---|---|---|---|---|
| 20 | 1.87 | 42.97 | 33.32 | 23.71 | 0.00 | 57.03 | 1.06 |
| 30 | 11.94 | 22.66 | 42.46 | 29.99 | 2.37 | 74.82 | 8.93 |
| 40 | 28.60 | 14.75 | 45.81 | 34.41 | 0.48 | 80.71 | 23.08 |
| 50 | 39.10 | 10.13 | 44.64 | 37.35 | 2.80 | 84.79 | 33.15 |
| 57 | 43.76 | 6.84 | 43.99 | 42.01 | 1.37 | 87.37 | 38.23 |

METHOD OF MANUFACTURING OXYGENATED FUEL

INCORPORATION BY REFERENCE

The disclosure of Japanese Patent Application No. HEI 12-086770 filed on Mar. 27, 2000 including the specification, drawings and abstract is incorporated herein by reference in their entirety.

BACKGROUND OF THE INVENTION

1. Field of the Invention

This invention relates to improvement of a method of manufacturing oxygenated fuel to be used for diesel engines etc.

2. Description of Related Art

Conventionally, a diesel fuel that has outstanding lubricity, oxidation stability, and a high cetane number has been desired. For example, Japanese Patent Publication for PCT No. HEI 11-513730 (note: WO97/14769) discloses a manufacturing method of such a diesel fuel.

In the conventional technology, hydrocarbons that are obtained from a synthesis gas (mixture of hydrogen and carbon monoxide) through Fischer-Tropsch process (hereinafter abbreviated as "FT process"), whose main component is paraffin, are separated into a light fraction and a heavy fraction. The heavy fraction is subjected to isomerization treatment while the light fraction is not subjected to the aforementioned treatment.

Incidentally, as a catalyst to be used in the Fischer-Tropsch process, a catalyst formed from silica $SiO_2$, alumina $Al_2O_3$, or the like impregnated with cobalt is in use.

In the conventional manufacturing method of diesel fuel, the light fraction is directly mixed as it is with the heavy fraction that has been subjected to the isomerization treatment. Because the light fraction has a high ratio of olefin, when it is used in diesel fuel, it results in a large generation of soot when the diesel fuel is combusted.

SUMMARY OF THE INVENTION

In view of the foregoing conventional problem, it is an object of the invention to provide a method of manufacturing an oxygenated fuel that excels in lubricity, oxidation stability, and has a high cetane number and that can suppress the generation of soot.

To achieve this object, the invention provides a method of manufacturing an oxygenated fuel wherein, by reacting an olefin with the synthesis gas using a solid catalyst to induce an oxo process, oxygenates are synthesized.

Moreover, in the method of manufacturing the oxygenated fuel, the olefin may be obtained from the synthesis gas through the Fischer-Tropsch reaction.

Since the oxygenated fuel manufactured in this way contains mainly oxygenates such as alcohol and aldehyde the oxygenated fuel has excellent lubricity and oxidization stability and has a high cetane number as well as the capability to suppress the generation of soot effectively when the oxygenated fuel is combusted.

BRIEF DESCRIPTION OF THE DRAWINGS

The above and other objects, features, advantages, and technical and industrial significance of this invention will be better understood by reading the following detailed description of a presently preferred embodiment of the invention, when considered in connection with the accompanying drawing, in which.

Figure 1:
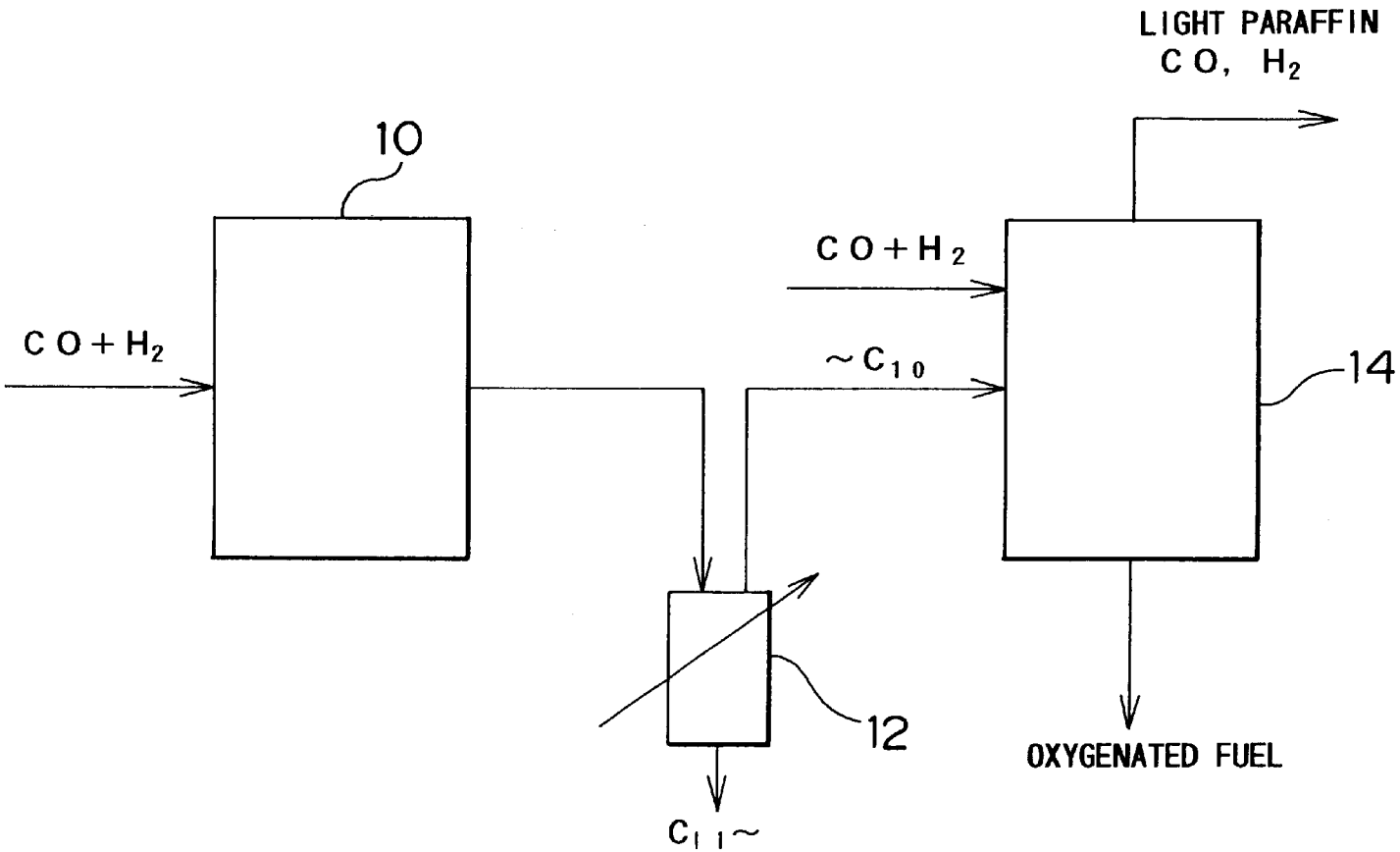
FIG. 1 is a view showing an example of a process of the method of manufacturing an oxygenated fuel according to the invention.

TABLE 1 is a table showing a comparison of the reaction activity of various cobalt catalysts that are formed by impregnating silica gel with cobalt (Co);

TABLE 2 is a table showing a comparison of the reaction activity for the oxo process conducted in various solvents;

TABLE 3 is a table showing a comparison of the reaction activity for cases where active carbon is used as a catalyst support with varying amounts of cobalt impregnation;

TABLE 4 is a table showing a comparison of the influence of reaction temperature on the oxo process; and TABLE 5 is a table showing a comparison of the influence of reaction pressure on the oxo process.

DESCRIPTION OF THE PREFERRED EMBODIMENTS

In the following description and the accompanying drawings, the present invention will be described in more detail in terms of specific embodiments.

Before describing the embodiments according to the invention, the main chemical terms used in this description will be described.

"Fischer-Tropsch process": a synthetic method for manufacturing an oxygenated fuel using a mixed gas of carbon monoxide (CO) and hydrogen ($H_2$) of a predetermined proportion as a raw material with a metal catalyst such as cobalt (Co), iron (Fe), and ruthenium (Ru).

"Isomerization": a process whereby a chemical compound is changed into an isomer that has the same molecular formula as that of the original compound but whose chemical or physical property is different from that of the original compound by changing the integrated state of atoms or atomic groups forming the chemical compound through a chemical or physical action.

"Oxo process": a method for synthesizing an aldehyde whose number of carbons is larger than that of an olefin by one by adding carbon monoxide and hydrogen to the olefin and catalyzing these by a catalytic action of an oxo catalyst. Conventional oxo catalysts use complexes such as cobalt (Co) and rhodium (Rh), and the oxo process is conducted under high pressure conditions (e.g. 130 to 300 kgf/cm$^2$=13 to 30 MPa).

"Complex": a compound comprising a central atom or a central ion of a metal or an atomic analog of a metal to which monodentate ligands or multidentate ligands which are negative, neutral, or positive are coordinated.

"Light fraction": a fraction whose volatility is high among components of a mixed liquid.

"Precursor": a substance in a previous stage from which a product can be obtained by a chemical reaction.

"Conversion": a ratio expressed in percent figures of a raw material consumed in a chemical reaction process under a certain condition to an initial number of moles of the raw material.

"Selectivity": a degree indicating how much selective progress a target main reaction makes in a reaction. The selectivity is a ratio of the number of moles that was converted into an object product to the number of total moles that has reacted in the reaction, expressed in percent figures.

"Yield": in a chemical process where a raw material is converted into an object material, a ratio of the number of moles of the object material actually generated to the number of moles of the object material to be generated theoretically.

"Olefin": aliphatic unsaturated hydrocarbon having one double bond, whose general formula is expressed by $C_nH_{2n}$.

"α-olefin": olefin that has a double bond at the end.

"Straight chain": a chain compound that has a carbon chain comprising carbons connected to one other in a straight chain shape without branching.

"Branched": a chain compound such that a molecule has a side chain with respect to the main chain.

Hereafter, embodiments according to the invention will be described.

Olefins, especially α-olefins, are easy to convert into oxygenates through the oxo process. An example of such an oxo process is shown in the following.

[Chemical Formula 1]

$$R—CH{=}CH_2+CO+H_2 \rightarrow R—CHCH_3—CHO \text{ (branched)} \rightarrow R—CH_2CH_2CHO \text{ (straight chain)} \quad (1\text{-}1)$$

$$R—CH{=}CH_2+CO+2H_2 \rightarrow R—CH_2CH_2OH \quad (1\text{-}2)$$

$$R—CH{=}CH_2+CO+CH_3OH \rightarrow R—CH_2CH_2CH_2OCOCH_3 \quad (1\text{-}3)$$

In this case, for an α-olefin serving as raw material, for example, one that is obtained from a petroleum refining process can be used. Moreover, since a main component of light naphtha that is generated in a Fischer-Tropsch (hereinafter, abbreviated as "FT") process is an α-olefin, this component can also be used.

The FT process reaction is conducted, for example, by using an FT synthetic catalyst that is formed by impregnating silica with one of cobalt (Co), iron (Fe), ruthenium (Ru), etc. and contacting the catalyst with the synthesis gas (mixture of hydrogen ($H_2$) and carbon monoxide (CO)).

Moreover, the aforementioned oxo process is conducted by reacting the olefin with the synthesis gas using a solid catalyst. As the solid catalyst for this reaction, a cobalt catalyst, for example, that is formed by impregnating silica, activated carbon, or the like with cobalt is used. Incidentally, in the case where ester is synthesized from olefin as expressed by the formula (1-3), alcohol such as methanol is used instead of hydrogen. Also in some cases, an alcohol such as methanol is used along with hydrogen.

As described above, in the case where the FT process is employed as a supply source of an α-olefin, it is desirable that the FT process as a preliminary step and the oxo process as a later step are conducted under nearly equal pressure conditions, respectively. In the conventional oxo process, a pressure condition of 130 to 300 atm (atm=atmospheric pressure)≡130 to 300 kgf/cm$^2$=13 to 30 MPa is essential, so that the pressure had to be raised. The reason for this is that a conventionally used catalyst uses complex of cobalt (Co), complex of rhodium (Rh), or the like so the reaction needs to be conducted under high pressure in order to protect this catalyst metal by surrounding it with CO etc. In this embodiment, however, the oxo process is conducted using a solid catalyst that is suspended and dispersed in the solvent, and consequently the reaction can take place at a pressure lower than that in the conventional case where a complex catalyst is used. Accordingly, a pressurizing mechanism such as a compressor becomes unnecessary. For example, since manufacturing of the synthesis gas that is a raw material of the FT process is conducted normally at a pressure of 30 to 40 atms, with the aforementioned method, both the FT process and the oxo process can be conducted at a pressure of 30 to 40 atms, which is preferable.

The oxygenates synthesized as described above can be used for an oxygenated fuel for diesel engines etc.

FIG. 1 shows an example configuration of a method of manufacturing an oxygenated fuel in the case where the Fischer-Tropsch process is employed as a supply source of the olefin. In a first reaction vessel 10, an FT catalyst that is formed by impregnating silica with cobalt (Co), iron (Fe), ruthenium (Ru), etc. is contained and the synthesis gas (mixture of carbon monoxide and hydrogen) is supplied thereinto. In this first reaction vessel 10, the FT process is conducted at a temperature of approximately 230 to 280° C. and at a pressure of approximately 30 to 40 atms to synthesize hydrocarbons containing a large amount of olefin.

The hydrocarbons synthesized in the first reaction vessel 10 are supplied to a heat exchanger 12, where the hydrocarbons are separated into the heavy fraction consisting of compounds for each of which the number of carbons is larger than 10 and the light fraction consisting of compounds for each of which the number of carbons is equal to or less than 10. The heavy fraction is used for fuel oil etc.

Moreover, the light fraction is supplied to a second reaction vessel 14, where the oxo reaction takes place with respect to the olefin of which the number of carbon is equal to or less than 10. That is, in the second reaction vessel 14, the cobalt catalyst etc., namely the solid catalyst described above, that is formed by impregnating silica with cobalt is contained, and the synthesis gas (mixture of hydrogen and carbon monoxide) is supplied thereinto in addition to the light fraction supplied from the heat exchanger 12. In this way, the oxo process is conducted in the second reaction vessel 14 according to the aforementioned reaction formula. Through this reaction, the olefin of which the number of carbons is equal to or less than 10 that is included in the light fraction supplied from the heat exchanger 12 is converted into oxygenates such as alcohol and aldehyde. Since such oxygenates has a high boiling point, it is taken out of a liquid phase part in the second reaction vessel 14 to be used as oxygenated fuel. Unreacted synthesis gas, light paraffin, etc. are also extracted from a gaseous phase part in the second reaction vessel 14.

By the process as specified in above, alcohol of C3 through C10 and fatty acid esters of C3 through C10 which are target oxygenates are synthesized.

Next, examination of the results concerning reaction conditions of the cobalt catalyst and others under which the aforementioned oxo process is conducted will be described.

TABLE 1 shows a comparison of the reaction activity of various cobalt catalysts that are formed by impregnating silica gel with cobalt.

In the catalyst column of TABLE 1, the figures shown are the weight percent (wt %) of metal cobalt impregnated into silica gel and letters N and A indicate that the cobalt salt serving as a precursor to impregnate cobalt into the silica gel is nitrate and acetate, respectively. Moreover, "/" indicates that the precursor shown on the left side of the symbol and the precursor shown on the right side of the symbol have been sequentially impregnated in that order with the left first and then the right into the silica gel. Moreover, "+" indicates that precursors linked together by this symbol have been impregnated into the silica gel simultaneously. In addition, the metal to be impregnated into silica gel is not limited to cobalt. Noble metals such as platinum (Pt), palladium (Pd), ruthenium (Ru), were also used. These are denoted by Pt (platinum), Pd (palladium), and Ru (ruthenium), respectively.

Using these various catalysts, respective reaction activities were investigated. The reaction conditions at that time were as follows: the aforementioned catalyst was 0.1 gram; 1-hexene as a raw material was 3.34 grams; reaction temperature was 130° C.; reaction time was 2 hours; reaction pressure was 50 atms; and supplied synthesis gas consisted of carbon monoxide, hydrogen, and argon with a composition of $CO:H_2:Ar$ at a ratio of 45.8:50.85:3.35.

TABLE 1 shows the conversion of 1-hexene that is the raw material when the oxo process was conducted under the aforementioned conditions. Table 1 also shows the selectivity of isomers and the selectivity of aldehyde (represented by "al") and alcohol (represented by "ol") that are oxygenates. Note that since 1-hexene is used as a raw material, the aldehyde and the alcohol that are formed by the oxo process have 7 carbons (C7) with an additional notation of "iso" for iso and "1" for normal, "1" indicating a position an aldehyde or an alcohol enters. Furthermore, the selectivity and the yield of the sum total of the aldehyde (al) and the alcohol (ol) are also shown.

In TABLE 1, the Run Number 1 is the cobalt catalyst used for the FT reaction shown in FIG. 1. If the same catalyst can be used both in the FT reaction and in the oxo reaction, simplification of the production process can be accomplished. However, the conversion of 1-hexene remains as low as 38.86%. In contrast to this, in the example of Run Number 2 where impregnation of 20 wt % cobalt into the silica gel was conducted two times and a total of 40 wt % cobalt was impregnated, the conversion of 1-hexene was 98.91% and both the selectivity and the yield of the sum total ("al"+"ol") reached almost 90%. From the results, it was found that when the quantity of cobalt that is impregnated into the silica gel is increased, catalytic activity is enhanced.

Moreover, in the Run Number 3 where not only cobalt nitrate but cobalt nitrate and cobalt acetate, each equivalent to 5 wt % by cobalt conversion as a precursor, were simultaneously impregnated into the silica gel when 10 wt % cobalt is to be impregnated into the silica gel, the conversion of 1-hexene decreased compared to that in Run Number 1. Then, when platinum, palladium, and ruthenium were added by 0.5 wt % each and impregnated into the silica gel (Run Numbers 4, 5, 6), both the conversion of 1-hexene and the yield of the sum total of the aldehyde and the alcohol were able to be improved compared to those in Run Number 3. Among these Run Numbers, it was found that especially the case where palladium was added had a large effect of accelerating the reaction.

Next, TABLE 2 shows a comparison of the reaction activity for cases where the oxo process was conducted in various solvents. Here, THF shown in TABLE 2 refers to tetrahydrofuran, which is also called oxolane.

As shown in TABLE 2, when either of methanol or ethanol was used as a solvent, the conversion of 1-hexene became close to 100% and a selectivity of 94% or so, as well as a yield of 94% or so respectively for the aldehyde and the alcohol that are oxygenates were able to be secured.

In contrast, other solvents did not always have as large of an effect on accelerating the reaction.

From the foregoing results, it is preferable that the oxo process be conducted in an alcohol solvent of either methanol or ethanol.

Next, TABLE 3 shows a comparison of the reaction activity when active carbon (AC) was used as a catalyst support instead of silica gel and the amount of cobalt impregnation was varied.

In TABLE 3, reaction conditions were as follows: the reaction temperature was 130° C.; the reaction pressure was 50 atms; the reaction time was 2 hours; and the composition was $CO:H_2:Ar$ at a ratio of 45.8:50.85:3.35. The active carbon used as the support was active carbon from KANTO KAGAKU.

In TABLE 3, when the amount of cobalt impregnation into the active carbon reached 20 wt % or more, the conversion of 1-hexene increased to 90% or more. Moreover, even when the amount of impregnation was 10 wt %, the conversion of 1-hexene was 67.8%, and a conversion higher than that with the silica gel designated by Run Number 1 shown in TABLE 1 (the amount of cobalt impregnation being 10 wt %) was achieved.

Next, TABLE 4 shows a comparison of influence of the reaction temperature as an operational factor of the oxo process.

In TABLE 4, the cobalt catalyst of Run Number 1 of TABLE 1 was used to conduct the reaction under the following conditions: the reaction pressure was 50 atms; the reaction time was 2 hours; and the composition was $CO:H_2:Ar$ at a ratio of 45.8:50.85:3.35.

As shown in TABLE 4, both the conversion of 1-hexene and the yield of the sum total of the aldehyde and the alcohol increase as the temperature increases at first, and when the reaction temperature exceeds a predetermined temperature, both values start to decrease. Therefore, it is thought that an optimal reaction temperature range be between approximately 110 and 140° C.

Next, TABLE 5 shows a comparison of influence of the reaction pressure that is another operational factor.

In TABLE 5, the cobalt catalyst of Run Number 1 of TABLE 1 was used to conduct the reaction under the following conditions: the reaction time was 2 hours; and the composition was $CO:H_2:Ar$ at a ratio of 45.8:50.85:3.35.

As shown in TABLE 5, both the conversion of 1-hexene and the yield of the sum total of the aldehyde and the alcohol increase as the reaction pressure increases. However, as described above, when the oxo process and the FT process are both conducted, it is preferable from the viewpoint of simplifying the reaction process that the pressures in the respective reactions be nearly equal to each other. It is therefore preferable to set the reaction pressures to a maximum of approximately 40 atms. Even at a pressure of this level it is rather difficult to obtain straight chain compounds, but the yield of the iso is thought to be sufficient for practical purposes. Since the oxygenates synthesized according to the invention are for fuel applications, it is not essential that the oxygenates are always straight chain compounds and the reaction need not be conducted at a high pressure which may require a costly production facility.

As described above, according to the invention, the oxygenates can be synthesized by means of the oxo process where an olefin is reacted with a synthesis gas using a solid catalyst, so that a fuel which has a high cetane number, excels in lubricity and oxidization stability, and produces less soot can be manufactured.

Moreover, the Fischer-Tropsch reaction can be employed as a supply source of the olefin, and at the same time the oxo process can be conducted under a pressure condition almost equal to that of Fischer-Tropsch reaction, thus making the efficient manufacturing of oxygenated fuel possible.

In addition, the reaction activity can be enhanced by adding a small quantity of a noble metal such as palladium as the solid catalyst other than just cobalt.

Furthermore, reaction activity of the oxo process can be further enhanced by using an alcohol solvent as the solvent.

Other embodiments of the invention will be apparent to those skilled in the art from consideration of the specification and practice of the invention disclosed herein. It is intended that the specification and examples be considered as exemplary only with the true scope and spirit of the invention being indicated by the following claims.

What is claimed is:

1. A process for manufacturing an oxygenated diesel fuel which comprises:

(a) initially conducting a Fischer-Tropsch synthesis wherein a mixture comprising hydrogen and carbon monoxide is reacted in the presence of a cobalt-containing catalyst at a pressure of 30 to 40 atmos.;

(b) recovering a mixture comprising α-olefins of 10 carbon atoms or less;

(c) thereafter conducting an oxo synthesis wherein said mixture of α-olefins is reacted with hydrogen and carbon monoxide at a pressure of 30 to 40 atmos.;

(d) recovering a mixture comprising oxygenates; and (e) processing the oxygenate mixture into a diesel fuel, wherein the Fischer-Tropsch synthesis and the oxo synthesis are conducted under substantially equal pressure conditions in one reaction system.

2. The process according to claim 1, wherein the oxo synthesis is conducted in the presence of an alcohol solvent and a catalyst comprising a silica or carbon carrier impregnated with cobalt and a noble metal.

3. The process according to claim 1, wherein steps (a) and (c) are conducted at a temperature of 110°–140° C.

4. The process according to claim 1, wherein the catalyst in step (a) is formed by impregnating silica with cobalt.

5. The process according to claim 2, wherein the alcohol in step (c) is methanol or ethanol.

6. The process according to claim 1, wherein the catalyst comprises silica impregnated with up to 40% by wt. cobalt.

7. The process according to claim 2, wherein the noble metal comprises palladium.

* * * * *